US012642321B2

(12) United States Patent
Kozak

(10) Patent No.: US 12,642,321 B2
(45) Date of Patent: Jun. 2, 2026

(54) INNER DUTY BELT AND RELATED SYSTEM

(71) Applicant: KORE Essentials Inc., La Mesa, CA (US)

(72) Inventor: Karl Kozak, San Diego, CA (US)

(73) Assignee: KORE Essentials Inc., Santee, CA (US)

( * ) Notice: Subject to any disclaimer, the term of this patent is extended or adjusted under 35 U.S.C. 154(b) by 831 days.

(21) Appl. No.: 17/993,728

(22) Filed: Nov. 23, 2022

(65) Prior Publication Data

US 2023/0086647 A1 Mar. 23, 2023

Related U.S. Application Data

(63) Continuation of application No. 17/372,483, filed on Jul. 11, 2021, now Pat. No. 11,533,959.

(51) Int. Cl.
*A41F 9/00* (2006.01)

(52) U.S. Cl.
CPC ..... *A41F 9/002* (2013.01)

(58) Field of Classification Search
CPC ..... A41F 9/002; A41F 9/00; A41F 9/007
See application file for complete search history.

(56) References Cited

U.S. PATENT DOCUMENTS 3,171,409 A * 3/1965 Cetrone ..... A61F 5/028 2/311
4,063,313 A * 12/1977 Hagios ..... A41F 9/002 2/338
4,348,774 A * 9/1982 Woodson ..... A41F 9/002 128/95.1
4,964,401 A * 10/1990 Taigen ..... A61F 5/028 482/106
4,991,573 A * 2/1991 Miller ..... A61F 5/028 128/99.1
5,023,956 A * 6/1991 Fox ..... A44C 5/0053 40/640
5,035,523 A * 7/1991 Allinder ..... A47K 7/03 224/663
5,147,261 A * 9/1992 Smith ..... A61F 5/028 482/106
5,367,714 A * 11/1994 Hines ..... A41F 9/002 2/311
5,586,969 A * 12/1996 Yewer, Jr. ..... A61F 5/028 2/311
5,651,763 A * 7/1997 Gates ..... A61F 5/028 602/19

(Continued)

*Primary Examiner* — Richale L Quinn
(74) *Attorney, Agent, or Firm* — CP Lar Group PC; Cy Bates

(57) ABSTRACT

The disclosure concerns an inner duty belt and related system. The inner duty belt has an inner side and an outer side, and includes a waist portion having a first touch fastener coupled to the outer side, an attachment portion having a connecting element configured to engage with the waist portion, and a flexible portion disposed between the waist portion and the attachment portion. The flexible portion is configured to fold upon convergence of the waist and attachment portions. The flexible portion of the inner duty belt allows the inner duty belt to easily increase and decrease in circumference while engaged with an outer duty belt.

16 Claims, 6 Drawing Sheets

(56) References Cited

U.S. PATENT DOCUMENTS 6,108,822 A * 8/2000 Calagui ..... A41F 9/002 2/338
6,233,839 B1 * 5/2001 Ford ..... A41H 1/02 33/562
6,336,908 B1 * 1/2002 Slautterback ..... A41F 9/002 2/312
6,766,532 B1 * 7/2004 Cabana ..... A61F 5/028 2/310
7,143,483 B1 * 12/2006 Potzman ..... A44B 11/001 24/163 K
D554,268 S * 10/2007 Harding ..... D24/190
8,393,016 B2 * 3/2013 Wilkins-Gaudio ..... A41F 9/002 2/338
9,339,102 B2 * 5/2016 Iosilevich ..... A45F 3/14
10,398,184 B1 * 9/2019 Farkas ..... A41F 9/002
11,533,959 B1 * 12/2022 Kozak ..... A41F 9/002
2008/0104741 A1 * 5/2008 Miller ..... A41F 9/002 2/311
2008/0223888 A1 * 9/2008 Meunier ..... F41C 33/046 224/195
2008/0289084 A1 * 11/2008 Wilkins-Gaudio ..... A41F 9/02 2/338
2009/0235431 A1 * 9/2009 Bevley ..... A41F 9/00 2/338
2014/0259300 A1 * 9/2014 Iosilevich ..... A45F 3/14 2/300
2015/0181965 A1 * 7/2015 Wilkins-Gaudio ..... A41F 9/02 2/338
2015/0272249 A1 * 10/2015 Glenn ..... A41F 9/002 2/338
2016/0227861 A1 * 8/2016 May ..... A45F 5/021
2017/0000249 A1 * 1/2017 Beck ..... A41F 9/002
2019/0069622 A1 * 3/2019 Thompson ..... A41F 9/002
2019/0166984 A1 * 6/2019 Wall ..... A45F 5/021
2020/0205496 A1 * 7/2020 Buell ..... A41F 9/002
2020/0345091 A1 * 11/2020 Chen ..... A44B 11/06
2021/0025672 A1 * 1/2021 Shearer ..... F41C 33/041
2023/0086647 A1 * 3/2023 Kozak ..... A45F 5/021 2/321

* cited by examiner

INNER DUTY BELT AND RELATED SYSTEM

BACKGROUND

Field of the Invention

This invention relates to belts; more particularly, to belts for carrying equipment.

Description of the Related Art

Law enforcement personnel, military personnel, and the like must carry a plethora of gear while on duty. Such equipment may include, inter alia, a firearm, handcuffs, taser, flashlight, baton, key ring hook, radio, spare magazines, and pepper spray. Options available include load-bearing vests and duty belts. Both are capable of carrying the gear in a readily accessible manner while leaving the hands of a user free to interact.

Duty belts, also known as battle belts or tactical belts, generally comprise an inner duty belt and an outer duty belt configured to engage with the inner duty belt. The inner duty belt is weaved through the user's belt loops of their pants. The gear is placed on the outer duty belt and the outer duty belt then engages with the inner belt via a hook-and-loop system and/or belt keepers. Although the duty belt is a popular choice, problems still exist. For example, fitting the outer duty belt with the inner duty belt is typically done by trial-and-error with multiple attempts needed for readjustments. Precise engagement between the inner duty belt and outer duty belt is critical. If the outer duty belt is too loose, the gear will not line up as planned and will not be held as securely to the user's waist as necessary. If the outer duty belt is too tight, the user may lose valuable space needed for the duty gear and the user will become critically uncomfortable. Furthermore, to relieve the tightness of the duty belt while in a sitting position, the user must disengage both the outer and inner duty belts which can be time consuming and may cause the outer duty belt to at least partially disengage with the inner duty belt.

There remains a need for an improved duty belt.

SUMMARY

The disclosure concerns an inner duty belt and related system. The inner duty belt having an inner side and an outer side, comprises a waist portion having a first touch fastener coupled to the outer side, an attachment portion having a connecting element configured to engage with the waist portion, and a flexible portion disposed between the waist portion and the attachment portion, wherein the flexible portion is configured to fold upon convergence of the waist and attachment portions. The flexible portion of the inner duty belt allows the inner duty belt to easily increase and decrease in circumference while engaged with an outer duty belt.

BRIEF DESCRIPTION OF THE DRAWINGS

Other features, combinations, and embodiments will be appreciated by one having the ordinary level of skill in the art of belts and accessories upon a thorough review of the following details and descriptions, particularly when reviewed in conjunction with the drawings, wherein.

DETAILED DESCRIPTION

Figure 1A:
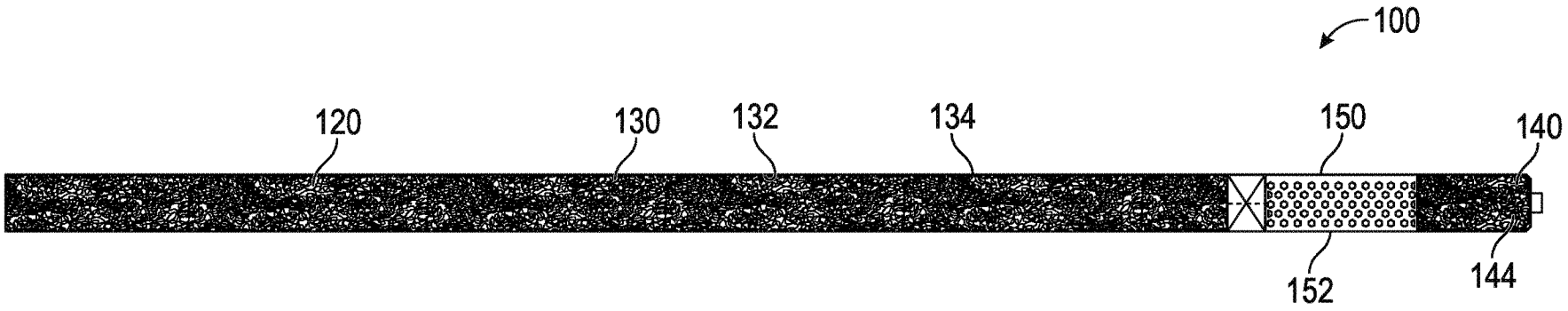
FIG. 1A shows an outer side of an inner duty belt in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "flexible" means having a lower relative stiffness, wherein stiffness is a measure to which an object resists deformation in response to an applied force. Flexibility, and conversely stiffness, of a planar object is determined by a thickness and/or material associated therewith. A planar object having a greater thickness and/or lower elastic modulus material with have a higher stiffness and consequently lower flexibility.

The term "touch fastener" means a hook fastener or a loop fastener.

The term "hook fastener" means a hook component of a hook-and-loop fastener system and is sewn or otherwise adhered to a linear fabric strip and is configured to engage with a loop fastener.

The term "loop fastener" means a loop component of a hook-and-loop fastener system and is sewn or otherwise adhered to a linear fabric strip and is configured to engage with a hook fastener.

The term "fold" means a material being relatively flexible and flat that can bend over itself so that one part of it covers another.

Unless explicitly defined herein, terms are to be construed in accordance with the plain and ordinary meaning as would be appreciated by one having skill in the art.

General Description of Embodiments

In a first embodiment, an inner duty belt is disclosed. The inner duty belt includes an inner side and an outer side opposite the inner side. The inner duty belt comprises a waist portion, an attachment portion, and a flexible portion. The waist portion has a waist portion thickness associated therewith. The waist portion further comprises a first loop fastener coupled to the outer side. The attachment portion has an attachment portion thickness associated therewith. The attachment portion comprises a first hook fastener coupled to the inner side and configured to engage with the first loop fastener. The flexible portion has a flexible thickness. The flexible portion is disposed between the waist portion and the attachment portion, wherein the flexible portion is configured to fold upon convergence of the waist and attachment portions. The waist portion thickness and attachment portion thickness are each greater than the flexible thickness.

In some embodiments, the flexible portion may further comprise a plurality of apertures.

In some embodiments, the waist portion may further comprise a second loop fastener coupled to the inner side, wherein the second loop fastener is configured to engage with the first hook fastener.

In some embodiments, the inner duty belt may further comprise a third loop fastener coupled to the attachment portion at the outer side.

In a second embodiment, an inner duty belt is disclosed. The inner duty belt comprises an inner side and an outer side opposite the inner side, a waist portion having a first touch fastener coupled to the outer side, an attachment portion having a connecting element configured to engage with the waist portion, and a flexible portion disposed between the waist portion and the attachment portion, wherein the flexible portion is configured to fold upon convergence of the waist and attachment portions.

In some embodiments, the first touch fastener may comprise a loop fastener being a first loop fastener. In other embodiments, the first touch fastener may comprise a hook fastener.

In some embodiments, the connecting element may be configured to engage with the waist portion at the outer side of the waist portion. In other embodiments, the connecting element may be configured to engage with the waist portion at the inner side of the waist portion.

In some embodiments, the connecting element may comprise a first hook fastener coupled to the attachment portion at the inner side, wherein the first hook fastener is configured to couple to the waist portion. In some embodiments, the first hook fastener may be configured to couple to the waist portion at the first loop fastener. In other embodiments, the first hook fastener may be configured to couple to the waist portion at the inner side.

In some embodiments, the waist portion may further comprise a second loop fastener coupled to the inner side, wherein the second loop fastener may be configured to engage with the first hook fastener.

In some embodiments, the inner duty belt may further comprise a waist portion thickness associated with the waist portion, an attachment portion thickness associated with the attachment portion, and a flexible thickness associated with the flexible portion, wherein the waist portion thickness and the attachment portion thickness are each greater than the flexible thickness.

In some embodiments, the flexible portion may further comprise a plurality of apertures.

In some embodiments, the inner duty belt may further comprise a third loop fastener coupled to the attachment portion at the outer side.

In a third embodiment, a duty belt system is disclosed. The duty belt system comprises an outer duty belt, and an inner duty belt. The outer duty belt comprises an interior side and an exterior side opposite the interior side, a second touch fastener coupled to the interior side, a plurality of engagement elements coupled to the exterior side, and a coupler attached to a first terminal end, the coupler being configured to attach to a second terminal of the outer duty belt. The inner duty belt comprises an inner side and an outer side opposite the inner side, a waist portion having a first touch fastener coupled to the outer side, an attachment portion having a connecting element configured to engage the waist portion, and a flexible portion disposed between the waist portion and the attachment portion. The interior side of the outer duty belt is configured to engage with the outer side of the inner duty belt, such that upon the first terminal end being attached to the second terminal end, the flexible portion is configured to fold, thereby allowing convergence of the waist portion to the attachment portion of the inner duty belt.

In some embodiments, the first touch fastener may comprise a loop fastener being a first loop fastener, and the second touch fastener may comprise a hook fastener being a second hook fastener. In other embodiments, the first touch fastener may comprise a hook fastener and the second touch fastener may comprise a loop fastener.

In some embodiments, the connecting element may comprise a first hook fastener coupled to the attachment portion at the inner side, wherein the first hook fastener is configured to couple to the waist portion. In some embodiments, the first hook fastener may be configured to couple to the waist portion at the first loop fastener. In other embodiments, the first hook fastener may be configured to couple to the waist portion at the inner side.

In some embodiments, the waist portion may further comprise a second loop fastener coupled to the inner side, wherein the second loop fastener is configured to engage with the first hook fastener.

In some embodiments, the inner duty belt may further comprise a waist portion thickness associated with the waist portion, an attachment portion thickness associated with the attachment portion, and a flexible thickness associated with the flexible portion, wherein the waist portion thickness and the attachment portion thickness are each greater than the flexible thickness.

In some embodiments, the flexible portion may further comprise a plurality of apertures.

In some embodiments, the inner duty belt may further comprise a third loop fastener coupled to the attachment portion at the outer side.

In some embodiments, the second terminal end of the outer belt may comprise a wrapping element configured to increase durability.

Manufacturing

Generally, the inner duty belt and outer duty belt can be made of leather or a synthetic thermoplastic polymer such as nylon. More specifically, the inner and outer duty belt can be made of ballistic nylon. Otherwise, the inner duty belt and outer duty belt can be fabricated in accordance with the level and knowledge of one having skill in the art.

The flexible portion can be made of material similar to other portions of the belt, such as nylon, and generally comprises a thickness small enough to provide the flexibility shown and described herein. Other materials that can be appreciated by one having skill in the art may be used as well. In an exemplary embodiment, the flexible portion comprises a thickness of $1/16^{th}$ inch. Other thickness may also be utilized to achieve similar results. The flexible portion may extend partially or fully within each of the attachment portion and waist portion.

The attachment portion may comprise a separate material attached to the flexible portion, or may comprise the flexible portion itself in addition to hook and/or loop fasteners disposed on either side of the attachment portion, thereby increasing the attachment portion thickness.

The hook fastener and loop fastener can each be obtained commercially, for example and without limitation Velcro® (https://www.velcro.com/business/products/textile-hook-and-loop/). Alternatively, the hook fastener and loop fastener cab be customized in accordance with the level and knowledge of one having skill in the art.

Each of the components of the inner duty belt and outer duty belt and related system described herein may be manufactured and/or assembled in accordance with the conventional knowledge and level of a person having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

Now turning to the drawings, FIG. 1A shows an outer side (120) of an inner duty (100) belt in accordance with a first illustrated embodiment. The inner duty belt comprises a waist portion (130) coupled to a flexible portion (150), and the flexible portion is further coupled to an attachment portion (140). The waist portion includes a first touch fastener (134) covering a substantial surface thereof. The first touch fastener as shown comprises a first loop fastener (132). Alternatively, the first touch fastener may comprise a hook fastener instead. The waist portion is configured to wrap around a user's waist and engage with an outer duty belt (200, FIG. 5A). The attachment portion is configured to engage with the waist portion and further includes a third loop fastener (144) such that upon engagement of the attachment portion to the waist portion, a section of the first loop fastener which is covered by the attachment portion is compensated by the third loop fastener. The third loop fastener can subsequently be configured to engage with the outer duty belt, along with the remaining uncovered first loop fastener disposed along the outer side of the waist portion. The flexible portion includes a plurality of apertures (152) and comprises a low stiffness such that when the attachment portion is engaged with the waist portion, and the outer duty belt is engaged with the inner duty belt, the flexible portion is configured to fold upon tightening of the outer duty belt, thereby allowing the waist portion and attachment portion to converge closer between the flexible portion. Additionally, upon loosening of the outer duty belt, the flexible portion is configured to unfold up to an original flat position, thereby providing slack to the user.

Figure 1B:
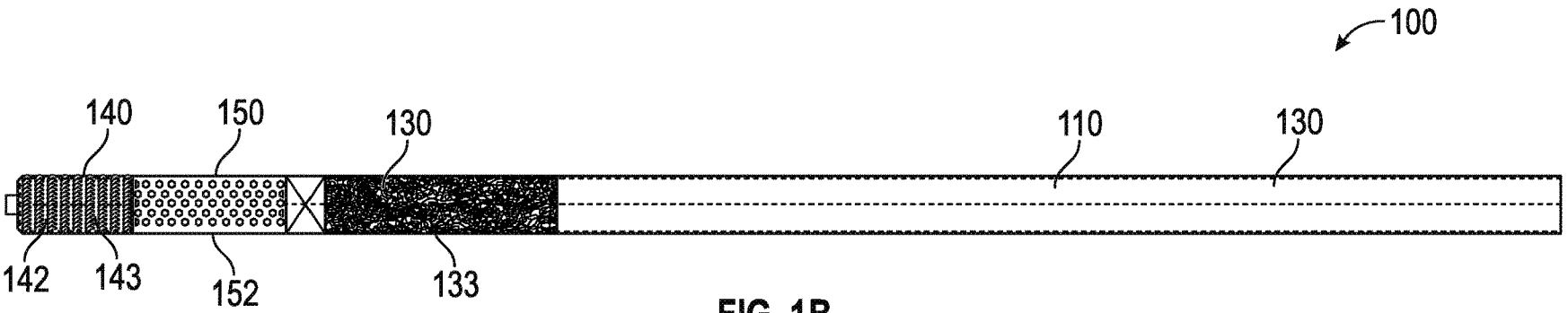
FIG. 1B shows an inner side of the inner duty belt according to the first illustrated embodiment.

FIG. 1B shows an inner side (110) of the inner duty belt (100) according to the first illustrated embodiment. The inner duty belt comprises a waist portion (130), an attachment portion (140), and a flexible portion (150) disposed therebetween. On the inner side, the attachment portion further includes a connecting element (142) being a first hook fastener (143) configured to engage with a first loop fastener (132, FIG. 1A) near an edge of the waist portion. The waist portion further comprises a second loop fastener (133) near the flexible portion. The second loop fastener is configured to engage with the connecting element as a way to store the flexible portion. A user may attach the connecting element to the second loop fastener instead of the waist portion while in use. In such a configuration, the attachment portion and flexible portion are both coupled to the waist portion at the inner side. A gap will be present between both ends of the waist portion while the inner belt is worn by the user. The gap can simulate the flexible portion by allowing the inner belt to tighten with relative ease with little to no obstruction.

In an alternative embodiment, the connecting element (142) comprises the third loop fastener (144, FIG. 1A) disposed on the outer side of the attachment portion (140), wherein the connecting element is configured to engage with the inner side (110) of the waist portion (130) by a corresponding hook component coupled therewith. In another embodiment, the outer side of the attachment portion (140) comprises a hook component instead of the third loop fastener, and is configured to engage with the inner side of the waist portion by a corresponding loop component coupled therewith. In yet other embodiments, the connecting element and/or the waist portion may comprise, for example and without limitation, a frame and prong buckle, a buckle with a polymer squeeze release, button snaps, or any other mechanism known to one having skill in the art for connecting two ends of a belt. The connecting element may be disposed on the inside or outside of the inner belt.

Figure 2:
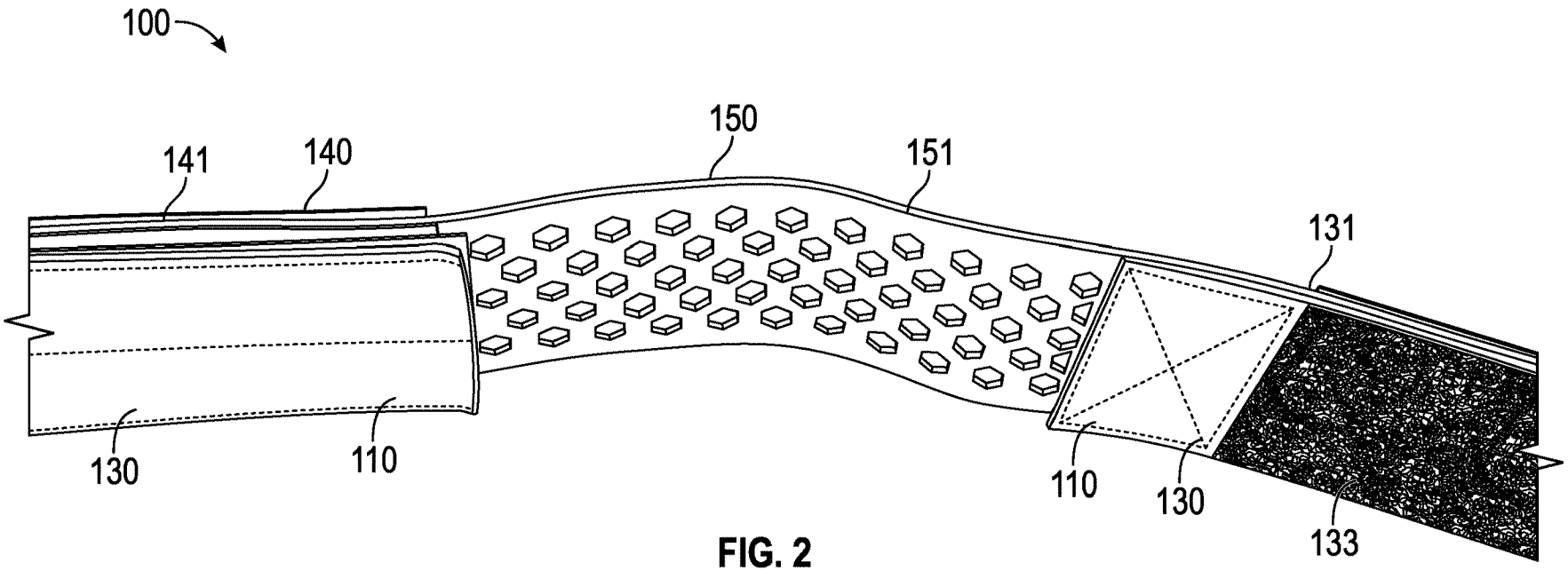
FIG. 2 shows rear view of the inner duty belt having an unfolded flexible portion according to the first illustrated embodiment.

FIG. 2 shows rear view of the inner duty belt (100) having an unfolded flexible portion (150) according to the first illustrated embodiment. The inner duty belt comprises a waist portion (130) and an attachment portion (140) each coupled to the flexible portion at either end thereof. As shown, the attachment portion is coupled to the waist portion and is shown in a perspective of a user with an inner side (110) shown. The flexible portion, the waist portion, and the attachment portion each comprise a flexible portion thickness (151), a waist portion thickness (131), and an attachment portion thickness (141), respectively. The flexible portion comprises a stiffness lower than either the waist portion or the attachment portion, thereby allowing the flexible portion to bend, fold, and unfold easily upon movement of the waist and attachment portions while the waist and attachment portions remain stiff for the purpose of securely holding duty gear. The lower stiffness can be achieved by the flexible portion comprising a material having a relatively high modulus of elasticity and/or comprising a relatively low thickness compared to remaining portions of the inner duty belt.

Figure 3:
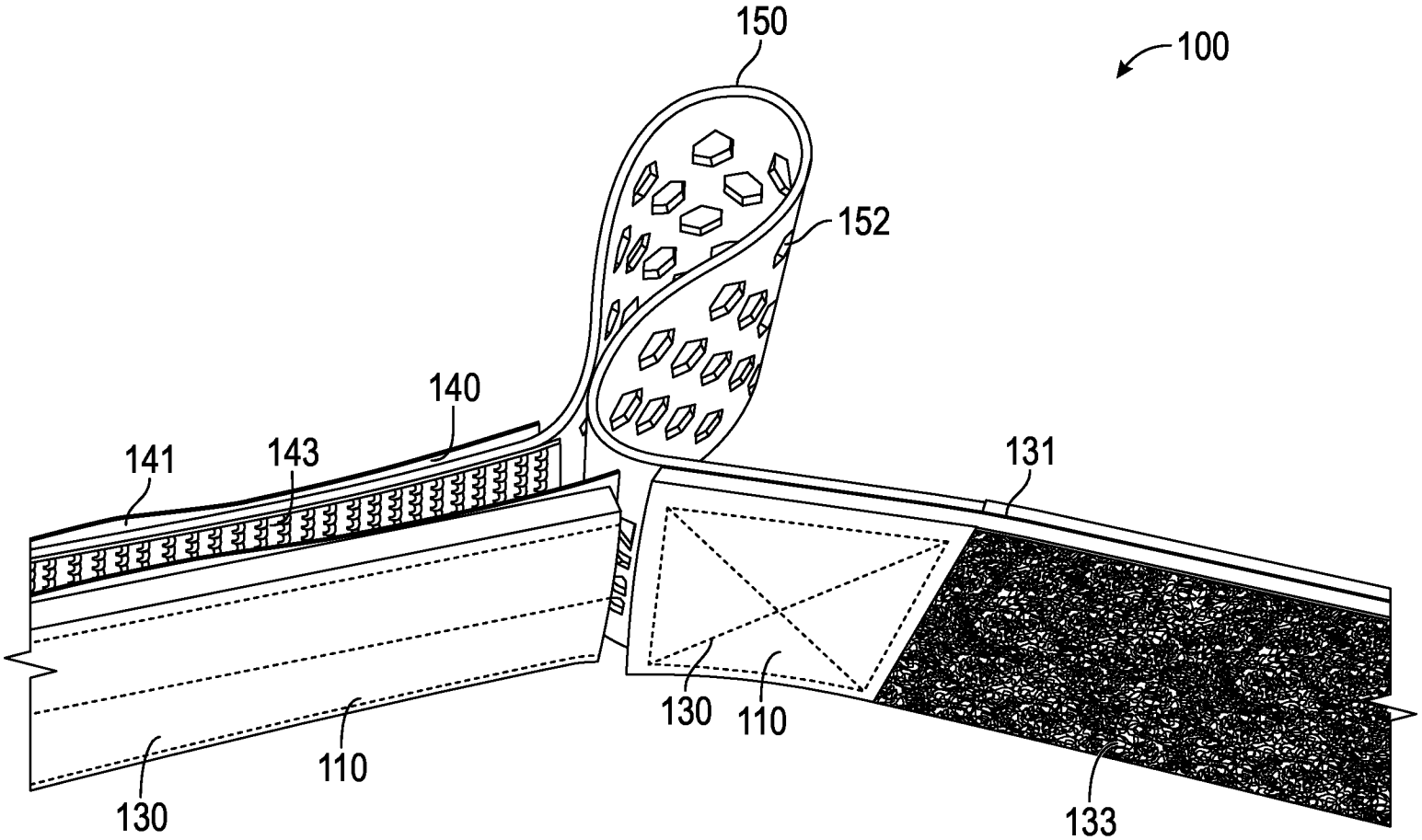
FIG. 3 shows a rear view of the inner duty belt having a folded flexible portion according to the first illustrated embodiment.

FIG. 3 shows a rear view of the inner duty belt having (100) a folded flexible portion (150) according to the first illustrated embodiment. The inner duty belt as shown, comprises an attachment portion (140) engaged with a waist portion (130) at an end via a first hook fastener (143) and first loop fastener (not shown). At an opposite end, the waist portion and the attachment portion are each coupled to the flexible portion. The waist portion and attachment portion are shown converged where the waist portion and attachment portion are each coupled to the flexible portion. The convergence of both waist and attachment portions decreases a circumference of the inner duty belt and the flexible portion is configured to fold to compensate for the decrease. The flexible portion further includes a plurality of apertures (152) to further reduce stiffness and increase flexibility. The flexible portion is shown bending away from the inner duty belt towards an outer side (not shown). However, it will be appreciated by one having skill in the art that the flexible portion can alternatively bend inwards toward an inner side (110).

Figure 4:
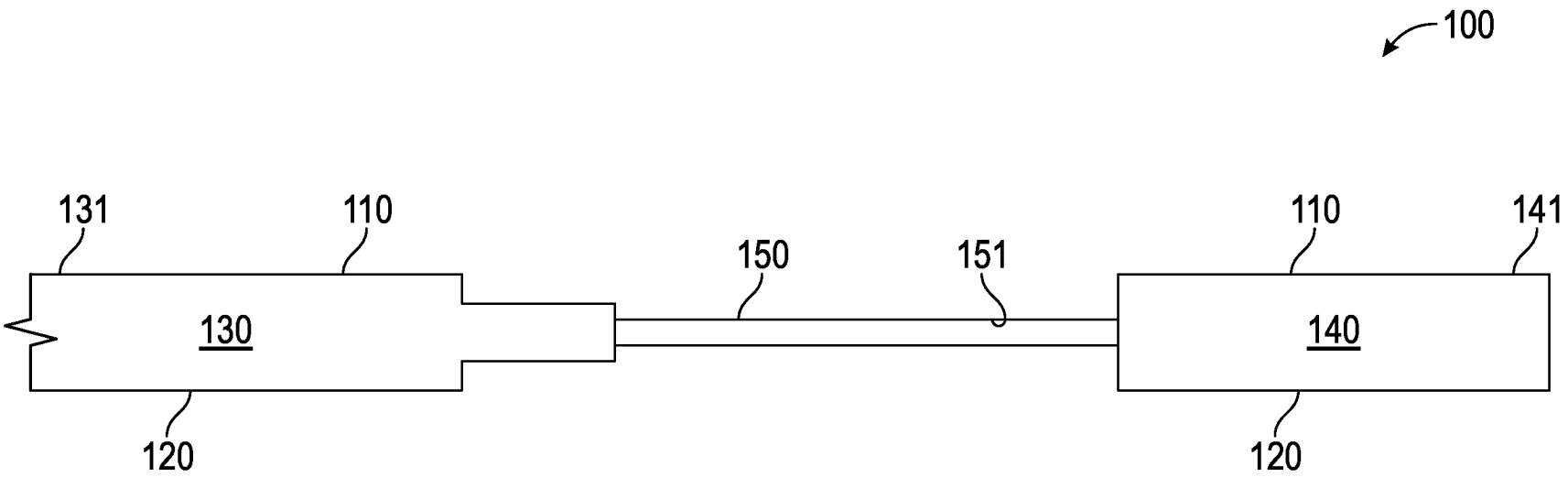
FIG. 4 shows a top view of the inner duty belt illustrating various thicknesses according to the first illustrated embodiment.

FIG. 4 shows a top view of the inner duty belt (100) illustrating various thicknesses according to the first illustrated embodiment. The inner duty belt comprises a waist portion (130) having a waist portion thickness (131), a flexible portion (150) having a flexible portion thickness (151), and an attachment portion (140) having an attachment portion thickness (141). The flexible portion thickness is less than either the waist portion thickness and the attachment portion thickness such that the flexible portion comprises a relatively low stiffness. The flexible portion is configured to fold upon convergence, or meeting, of the waist and attachment portions. In alternative embodiments, the flexible portion may comprise a flexible thickness equal to or greater than the waist portion thickness and attachment portion thickness. In such embodiments, the flexible portion comprises a material having a high modulus of elasticity which is capable of folding and thereby allowing the waist and attachment portions to come together.

Second Illustrated Embodiment

Figure 5A:
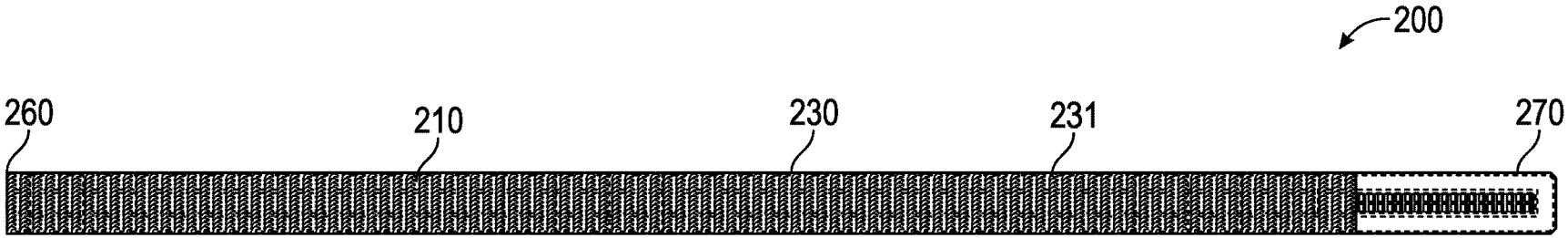
FIG. 5A shows an interior side of an outer duty belt in accordance with a second illustrated embodiment.

FIG. 5A shows an interior side (210) of an outer duty belt (200) in accordance with a second illustrated embodiment. The outer duty belt comprises a first terminal end (260) and a second terminal end (270) opposite the first terminal end. Disposed on the outer duty belt at the interior side is a second touch fastener (231) covering a substantial area of the outer duty belt. As shown, the second touch fastener comprises a second hook fastener (230). The second hook fastener is configured to engage with a first loop fastener (132, FIG. 1A) on an inner duty belt (100, FIG. 1A). If a third loop fastener (144, FIG. 1A) is also present, the second hook fastener is further configured to engage with said third loop fastener in addition to the first loop fastener. The outer duty belt is configured to comprise a coupler (250, FIG. 6) which can attach to the first terminal end to the second terminal end. The coupler may comprise a ratchet buckle, a frame and prong buckle, a squeeze release buckle, or any other mechanism known to one having skill in the art for attaching two ends of a belt.

Figure 5B:
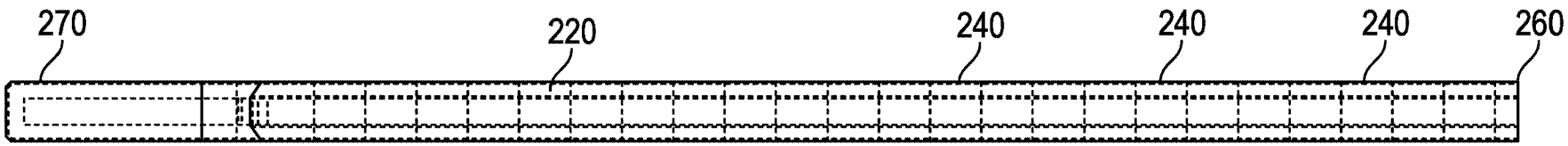
FIG. 5B shows an exterior side of the outer duty belt according to the second illustrated embodiment.

FIG. 5B shows an exterior side (220) of the outer duty belt (200) according to the second illustrated embodiment. The outer duty belt comprises a first terminal end (260) and a second terminal end (270) opposite the first terminal end. The outer duty belt comprises a plurality of engagement elements (240) disposed on the outer duty belt at the exterior side. Each of the plurality of engagement elements is configured to receive and hold equipment and pouches such as, inter alia, holster, pouches, radio, and key ring hook.

Third Illustrated Embodiment

Figure 6:
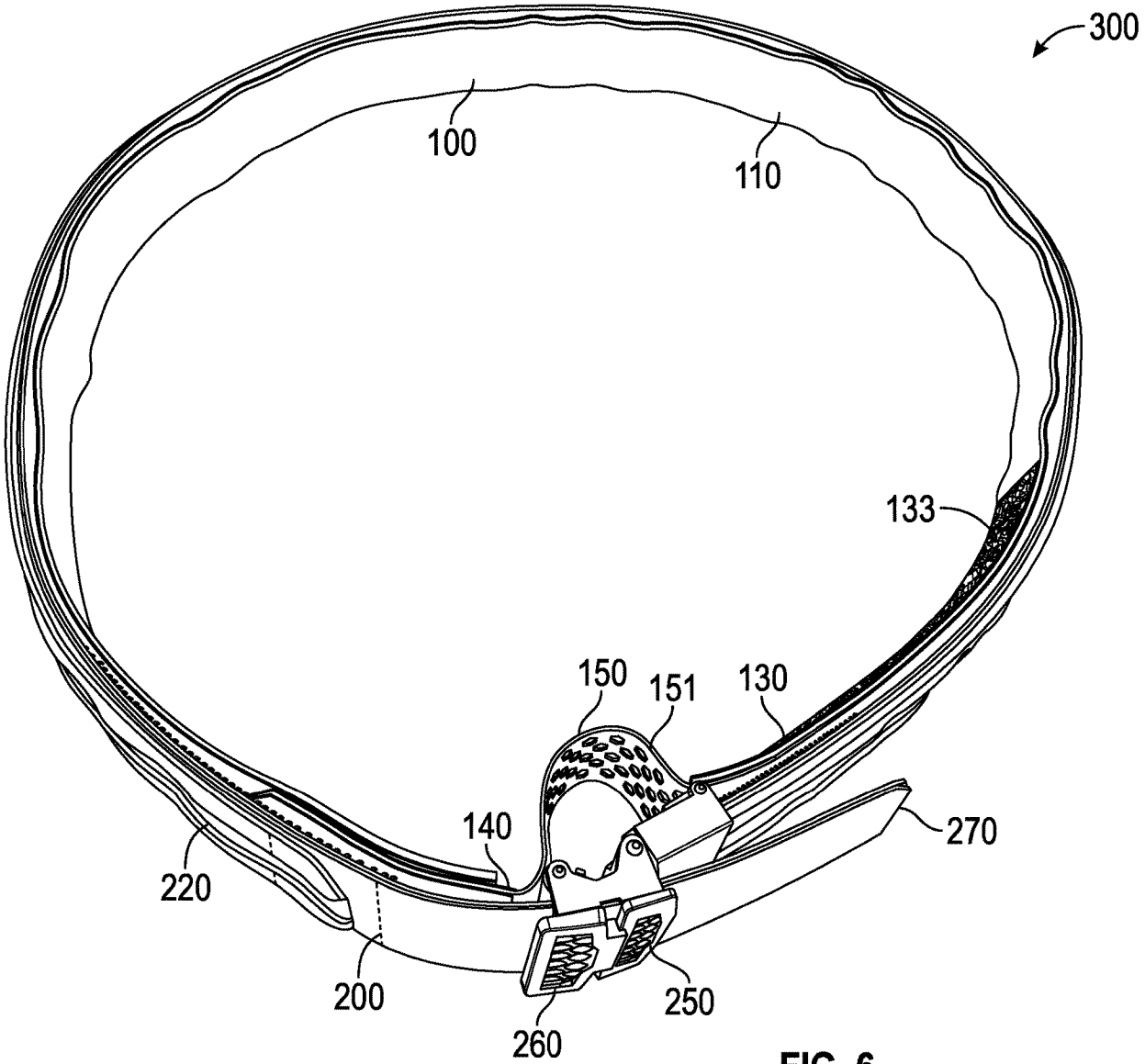
FIG. 6 shows a top view of a duty belt system in accordance with a third illustrated embodiment.

FIG. 6 shows a top view of a duty belt system (300) in accordance with a third illustrated embodiment. The duty belt system comprises an inner duty belt (100) engaged with an outer duty belt (200). The inner duty includes a flexible portion (150) coupled to a waist portion (130). The flexible portion is further coupled to an attachment portion (140). The attachment portion is engaged with the waist portion by hook and loop fasteners as previously shown and described. Furthermore, the inner duty belt is engaged with the outer duty belt by hook and loop fasteners as previously shown and described. The outer duty belt has a first terminal end (260) coupled to a second terminal (270) via a coupler (250). Due to the inner duty belt being engaged with the outer duty belt, when the outer duty belt is tightened to a smaller circumference associated therewith, the inner duty belt additionally tightens to a smaller circumference associated therewith. Upon the inner duty belt tightening to a smaller circumference, the waist portion and attachment portion move closer together and cause the flexible portion to fold and bend to compensate for a reduction in circumference. Additionally, once the outer duty belt is loosened by disengaging the coupler, the flexible portion is configured to unfold to an original position. This allows the duty belt system to remain on a user while providing short term relief.

FEATURE LIST inner duty belt (100)
inner side (110)
outer side (120)
waist portion (130)
waist portion thickness (131)
first loop fastener (132)
second loop fastener (133)
first touch fastener (134)
attachment portion (140)
attachment portion thickness (141)
connecting element (142)
first hook fastener (143)
third loop fastener (144)
flexible portion (150)
flexible thickness (151)
plurality of apertures (152)
outer duty belt (200)
interior side (210)
exterior side (220)
second hook fastener (230)
second touch fastener (231)
plurality of engagement elements (240)
coupler (250)
first terminal end (260)
second terminal end (270)
wrapping (280)
duty belt system (300)

What is claimed is:

1. An inner duty belt comprising:

a waist portion comprising a waist inner side and a waist outer side opposite the waist inner side, the waist portion further comprising a waist portion thickness measured from the waist inner side to the waist outer side;

an attachment portion comprising an attachment inner side and an attachment outer side opposite the attachment inner side, the attachment portion further comprising an attachment portion thickness measured from the attachment inner side to the attachment outer side, the attachment portion further comprising a connecting element disposed on the attachment inner side, the connecting element configured to couple to the waist outer side;

a flexible portion disposed between the waist portion and the attachment portion, the flexible portion comprising a flexible inner side and a flexible outer side, the flexible portion further comprising a flexible portion thickness measured from the flexible inner side to the flexible outer side wherein the waist portion thickness and the attachment portion thickness are each greater than the flexible portion thickness;

an inner side comprising the waist inner side, the attachment inner side, and the flexible inner side; and an outer side opposite the inner side, the outer side comprising the waist outer side, the attachment outer side, and the flexible outer side;

wherein the waist portion further comprises a waist loop fastener disposed on the waist inner side, the waist loop fastener configured to engage with the connecting element thereby causing the attachment portion and the flexible portion to each couple to the waist inner side.

2. The inner duty belt of claim 1, the flexible portion further comprising a plurality of apertures extending both vertically and horizontally along with the flexible portion.

3. The inner duty belt of claim 1, wherein the flexible portion is coupled to both the attachment portion and the waist portion such that the waist portion, the flexible portion, and the attachment form a serial alignment.

4. The inner duty belt of claim 1, the attachment portion further comprising an attachment loop fastener disposed on the attachment outer side.

5. The inner duty belt of claim 1, wherein the attachment inner side extends beyond the flexible inner side, and further wherein the attachment outer side extends beyond flexible outer side.

6. The inner duty belt of claim 1, wherein the waist inner side extends beyond the flexible inner side, and further wherein waist outer side extends beyond the flexible outer side.

7. The inner duty belt of claim 1, wherein the attachment inner side and the waist inner side each extends beyond the flexible inner side.

8. The inner duty belt of claim 1, wherein the attachment outer side and the waist outer side each extends beyond the flexible outer side.

9. An inner duty belt comprising:

a waist portion comprising a waist inner side and a waist outer side opposite the waist inner side, the waist portion further comprising a waist portion thickness measured from the waist inner side to the waist outer side;

an attachment portion comprising an attachment inner side and an attachment outer side opposite the attachment inner side, the attachment portion further comprising an attachment portion thickness measured from the attachment inner side to the attachment outer side, the attachment portion further comprising a connecting element disposed on the attachment inner side, the connecting element configured to couple to the waist outer side;

a flexible portion disposed between the waist portion and the attachment portion, the flexible portion comprising a flexible inner side and a flexible outer side, the flexible portion further comprising a flexible portion thickness measured from the flexible inner side to the flexible outer side wherein the waist portion thickness and the attachment portion thickness are each greater than the flexible portion thickness;

an inner side comprising the waist inner side, the attachment inner side, and the flexible inner side; and an outer side opposite the inner side, the outer side comprising the waist outer side, the attachment outer side, and the flexible outer side;

wherein the attachment inner side extends beyond the flexible inner side, and further wherein the attachment outer side extends beyond flexible outer side; and further wherein the waist portion further comprises a waist loop fastener disposed on the waist inner side, the waist loop fastener configured to engage with the connecting element thereby causing the attachment portion and the flexible portion to each couple to the waist inner side.

10. The inner duty belt of claim 9, wherein the flexible portion is coupled to both the attachment portion and the waist portion such that the waist portion, the flexible portion, and the attachment form a serial alignment.

11. The inner duty belt of claim 9, the attachment portion further comprising an attachment loop fastener disposed on the attachment outer side.

12. The inner duty belt of claim 9, wherein the waist inner side extends beyond the flexible inner side, and further wherein waist outer side extends beyond the flexible outer side.

13. An inner duty belt comprising:

a waist portion comprising a waist inner side and a waist outer side opposite the waist inner side, the waist portion further comprising a waist portion thickness measured from the waist inner side to the waist outer side;

an attachment portion comprising an attachment inner side and an attachment outer side opposite the attachment inner side, the attachment portion further comprising an attachment portion thickness measured from the attachment inner side to the attachment outer side, the attachment portion further comprising a connecting element disposed on the attachment inner side, the connecting element configured to couple to the waist outer side;

a flexible portion disposed between the waist portion and the attachment portion, the flexible portion comprising a flexible inner side and a flexible outer side, the flexible portion further comprising a flexible portion thickness measured from the flexible inner side to the flexible outer side wherein the waist portion thickness and the attachment portion thickness are each greater than the flexible portion thickness;

an inner side comprising the waist inner side, the attachment inner side, and the flexible inner side; and an outer side opposite the inner side, the outer side comprising the waist outer side, the attachment outer side, and the flexible outer side;

wherein the attachment inner side and the waist inner side each extends beyond the flexible inner side; and further wherein the waist portion further comprises a waist loop fastener disposed on the waist inner side, the waist loop fastener configured to engage with the connecting element thereby causing the attachment portion and the flexible portion to each couple to the waist inner side.

14. The inner duty belt of claim 13, wherein the flexible portion is coupled to both the attachment portion and the waist portion such that the waist portion, the flexible portion, and the attachment form a serial alignment.

15. The inner duty belt of claim 13, the attachment portion further comprising an attachment loop fastener disposed on the attachment outer side.

16. The inner duty belt of claim 13, wherein the attachment outer side and the waist outer side each extends beyond the flexible outer side.

* * * * *